United States Patent [19]

Averhoff

[11] Patent Number: 4,555,090

[45] Date of Patent: Nov. 26, 1985

[54] FENCE POST DRIVING AND PULLING APPARATUS

[76] Inventor: Wil W. Averhoff, Rte. 2, Box 309, Hwy. 171, South, Hubbard, Tex. 76648

[21] Appl. No.: 535,322

[22] Filed: Sep. 23, 1983

[51] Int. Cl.[4] ..... E21B 9/00

[52] U.S. Cl. ..... 254/29 R

[58] Field of Search ..... 254/29 R, 30, 31, 132; 269/82, 71, 60, 156

[56] References Cited

U.S. PATENT DOCUMENTS

| | | | |
|---|---|---|---|
| 1,127,708 | 2/1915 | Wilber | 269/71 |
| 1,327,673 | 1/1920 | Heckman | 254/31 |
| 2,096,320 | 10/1937 | Coleman | 269/60 |
| 2,376,676 | 5/1945 | Ferguson | 254/30 |
| 2,634,092 | 4/1953 | Lindquist . | |
| 2,681,789 | 6/1954 | Nichols . | |
| 2,685,430 | 8/1954 | Henke | 254/29 R |
| 2,742,258 | 4/1956 | Rosasco . | |
| 2,901,215 | 8/1959 | Jones . | |
| 2,940,267 | 6/1960 | Shaver | 254/29 R |
| 2,967,044 | 1/1961 | Corcreham et al. | 254/30 |
| 3,002,744 | 10/1961 | Phillips et al. | 269/60 |
| 3,059,905 | 10/1962 | Tompkins | 254/30 |
| 3,073,571 | 1/1963 | Wunsch . | |
| 3,129,924 | 4/1964 | Froh . | |
| 3,726,506 | 4/1973 | Vanderwoal et al. | 254/29 R |
| 3,789,894 | 2/1974 | Adams | 269/156 |
| 3,834,668 | 9/1974 | Casey | 254/29 R |
| 4,183,511 | 1/1980 | Marek | 269/60 |
| 4,256,286 | 3/1981 | Jodgins . | |
| 4,317,560 | 3/1982 | Troyer | 269/60 |
| 4,368,873 | 1/1983 | Perry | 254/29 R |

*Primary Examiner*—Robert C. Watson

*Attorney, Agent, or Firm*—Schley, Cantrell, Kice & Moore

[57] ABSTRACT

The main elements of the fence post driving and pulling apparatus include a frame, a track, a traveling slide, means for mounting the frame on a tractor, means for selectively securing a fence post to the traveling slide, and means for driving the traveling slide. The frame mounts to a tractor and the track is formed in the frame. The traveling slide is disposed for substantially vertical displacement within the track as driven by a hydraulic cylinder which is connected between the frame and the traveling slide. The hydraulic cylinder is actuated by the hydraulic power system available on the tractor upon which the device is mounted. A first clamp surface projecting from the traveling slide and an adjacent cam clamp surface presented by a cam which is rotatably connected to the traveling slide provide means for selectively securing the fence post to the traveling slide. A fence post is brought into place upon the face of the traveling slide between the first clamp surface and the cam clamp surface. Rotating the cam closes the gap between the cam clamp surface and the first clamp surface, thereby securely gripping the fence post to the traveling slide. Actuation of the hydraulic cylinder then lowers or raises the fence post with the traveling slide to drive or pull the fence post into and out of engagement with the ground.

9 Claims, 6 Drawing Figures

FENCE POST DRIVING AND PULLING APPARATUS

BACKGROUND

Modern farming practices utilize extensive fencing and crossfencing of the land and the most common fencing material is barbed wire. Taut strands of barbed wire are usually supported at relatively close intervals by metal posts driven into the ground. Setting such posts by hand is an arduous labor as each post must be driven between one and two feet into the ground for a satisfactorily secure footing.

It is an object of the present invention to provide improved power means for setting fence posts into the ground and the improved power means should be compatible with present farm equipment for actuation by power systems available on tractors, construction equipment, and the like.

Another object of the present invention is to improve means for securing the fence posts to the fence post driver in order to allow for rapid, secure engagement.

It is a further object of the present invention to provide extended support for the fence post as it is driven into the ground.

Finally, it is an object of the invention to provide an apparatus for driving fence posts that is equally proficient in removing fence posts from a secure footing in the ground.

SUMMARY OF THE INVENTION

The present invention is a vehicle mounted device for driving fence posts into the ground and, in the preferred embodiment, adapted for pulling fence posts from place once set. The main elements of the post driver include a frame, a track, means for mounting the frame to the vehicle, a traveling slide, means for selectively securing a fence post to the traveling slide, and means for driving the traveling slide. In the preferred embodiment, the means for driving the traveling slide is a hydraulic cylinder which is actuated by the hydraulic system available on a tractor or similar vehicle upon which the device is mounted.

The frame is mounted to the vehicle and the track is formed on the frame. The traveling slide is disposed for substantially vertical displacement within the track as driven by the hydraulic cylinder which is connected between the frame and the traveling slide. In the preferred embodiment, the means provided for selectively securing the fence post to the traveling slide includes a first clamp surface projecting from the traveling slide and an adjacent cam clamp surface presented by a cam which is rotatably connected to said traveling slide.

In using the fence post driver of the present invention, a fence post is brought into place upon the face of the traveling slide and between the first clamp surface projecting from the traveling slide and the cam clamp surface. Rotating the cam closes the gap between the cam clamp surface and the first clamp surface, thereby securely gripping the fence post to the traveling slide. Actuation of the hydraulic cylinder then lowers or raises the fence post with the traveling slide which is disposed within the stationary track, thereby driving into or pulling the fence post from secure engagement with the ground.

A BRIEF DESCRIPTION OF THE DRAWINGS

A DETAILED DESCRIPTION OF THE DRAWINGS

Figure 1:
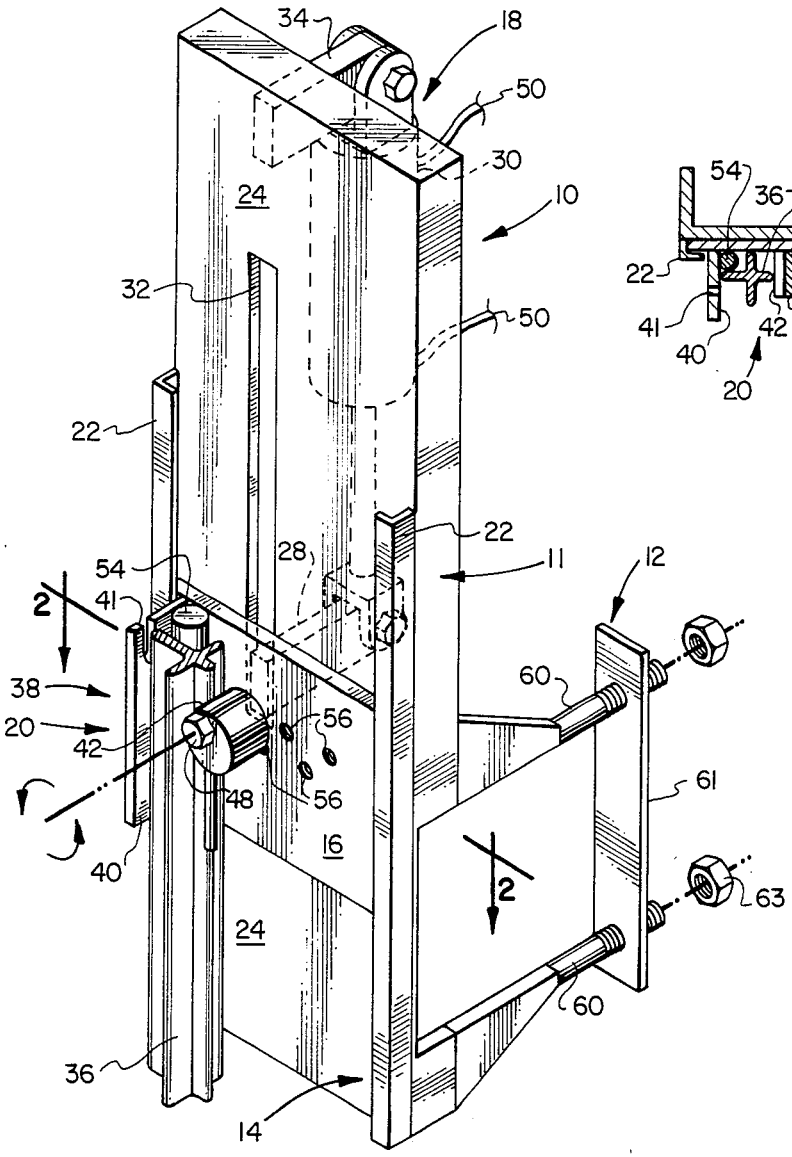
FIG. 1 is a perspective view of a fence post driving and pulling apparatus constructed in accordance with the present invention.

FIG. 1 is a perspective view of a fence post driving and pulling device constructed in accordance with the present invention designated generally as 10. The main elements of the fence post driver and puller include frame 11, mounting means 12 for mounting fence post driving and pulling device 10 to a vehicle; track 14, traveling slide 16, means for driving traveling slide 16 designated generally as 18, and means for selectively securing the fence post to the traveling slide, the securing means designated generally as 20.

Figure 3:
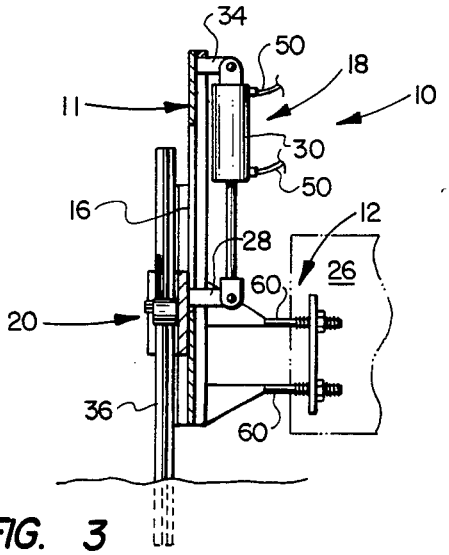
FIG. 3 is a side plane view of the fence post driving and pulling apparatus constructed in accordance with the present invention in which the cylinder is in the extended position.
Figure 4:
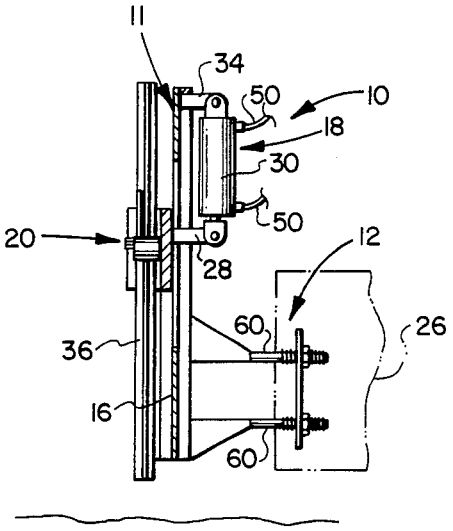
FIG. 4 is a side plane view of a fence post driving and pulling apparatus constructed in accordance with the present invention in which a cylinder is illustrated in a contracted position.

Mounting means 12 connects frame 11 of fence post driver and puller 10 to a vehicle such as a tractor, a bull-dozer or the like designated generally as 26 in FIGS. 3 and 4. Thus mounted, frame 11 presents track 14 formed thereon in a substantially vertical orientation. A simple mounting means 12 is illustrated in FIGS. 1, 3 and 4 in which mounting bolts 60 ridiidly connect to frame 11. In the illustrated embodiment, bolts 60 are securable about a tractor's axle with bars 61 secured by nuts 63.

Figure 5:
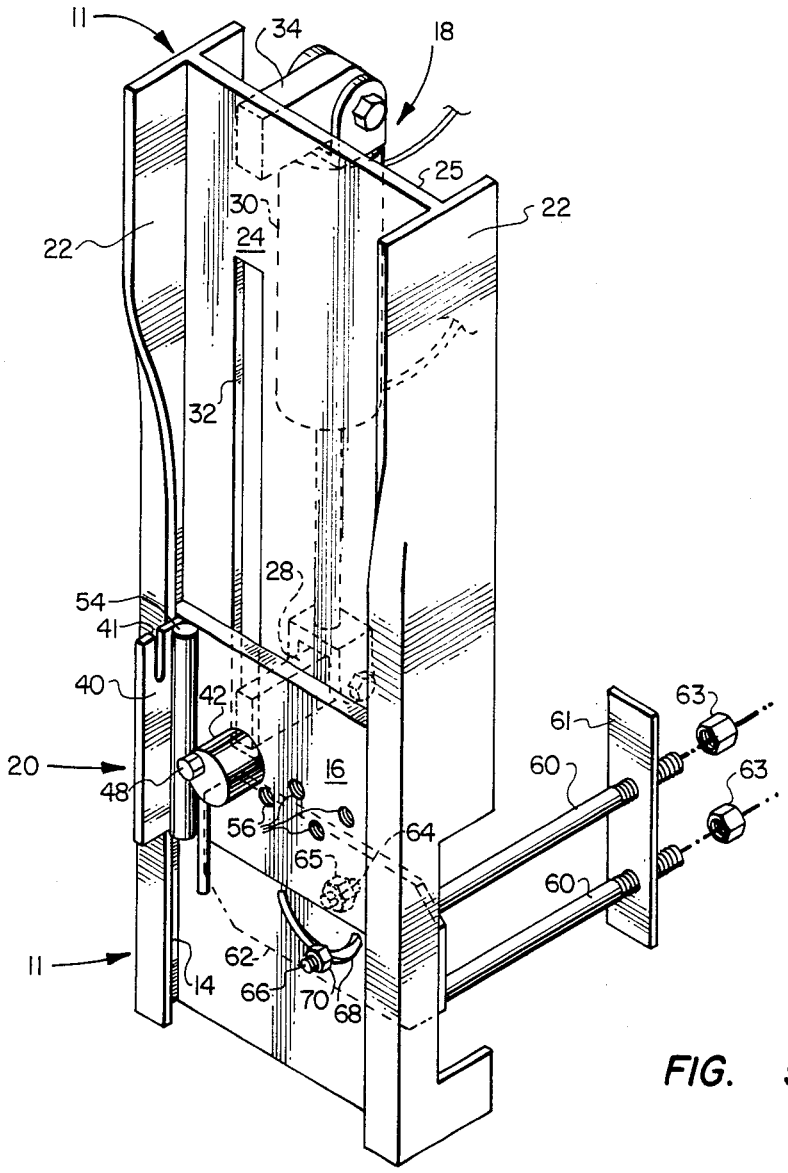
FIG. 5 is a perspective view of an alternate embodiment of the fence post driving and pulling apparatus constructed in accordance with the present invention.
Figure 6:
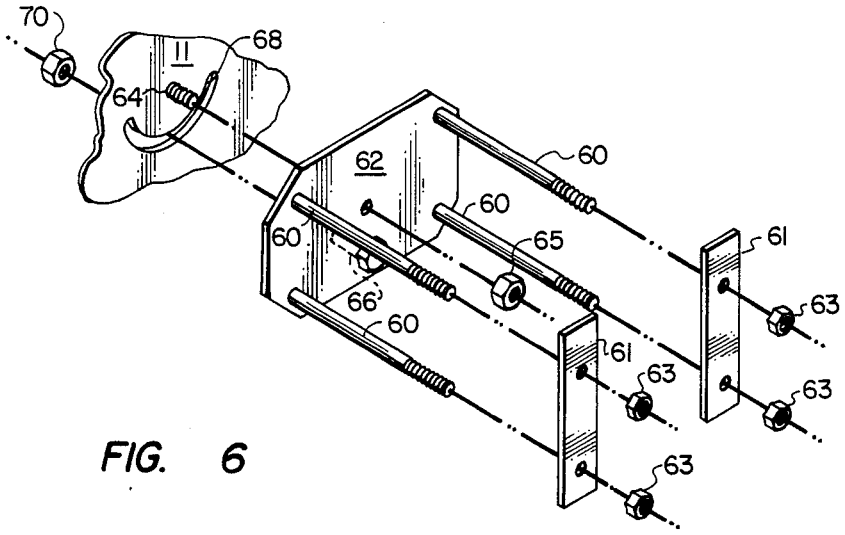
FIG. 6 is a perspective view of an adjustable mounting plate constructed in accordance with the present invention.

However, irregularities of the ground level are compensatible by providing for adjustment in the connection of frame 11 to mounting means 12. FIG. 6 is a perspective view of an alternative embodiment of a mounting means having a pivot plate 62 connectable a vehicle with bolts 60 and FIG. 5 is a perspective view of an alternate embodiment of the fence post driving and pulling apparatus of this present invention. Pivot plate 62 is rotatably connected to frame 11 by pivot bolt 64 rotatably secured with nut 65. Set bolt 66 projects from pivot plate 62 through an arcuate slot 68 in frame 11, below the lowermost throw of traveling slide 16. This arrangement for mounting means permits frame 11 to partially rotate about pivot bolt 64 until track 12 is presented in a vertical orientation even though the vehicle carrying fence post driving and pulling device 10 is on unlevel ground. Tightening nut 70 on set bolt 66 secures the track in the proper vertical orientation.

Figure 2:
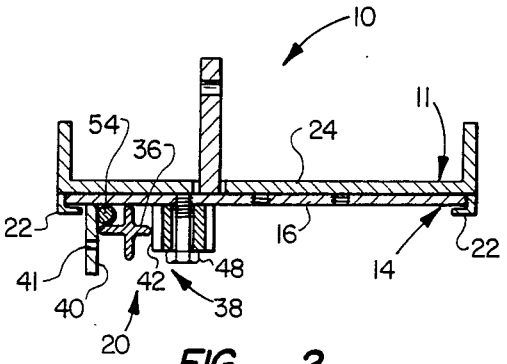
FIG. 2 is an overhead cross-sectional view of a fence post driving and pulling apparatus constructed in accordance with the present invention as that view is taken along line 2—2 of FIG. 1.

FIG. 2 is a cross-section of fence post driver and puller 10 taken along line 2—2 of FIG. 1.

In the embodiment of FIG. 5, track 14 is formed from an I-beam 25 having integral flanges 22 on either side of web 24. One side of frame 11 is connected to vehicle 26 through mounting means 12 and the other side of frame 11 presents track 14 having the substantially planar web 24 bounded on either sides by flanges 22 which converge inwardly in which traveling slide 16 is disposed for vertical movement in the alternative embodiment of FIG. 1 and 2, converging flanges 22 are added to the sides of web 24.

In both illustrated embodiments, track 14 on frame 11 is formed with vertical slot 32 through web 24 thereof through which traveling cylinder mount 28 projecting from the back of traveling slide 16 passes. The distended end of traveling cylinder mount 28 engages driving means 18 at hydraulic cylinder 30. The other or fixed end of hydraulic cylinder 30 is connected to the frame. In the preferred embodiment, the hydraulic cylinder 30 is driven by a hydraulic power system presented by the vehicle 26. Hydraulic fluid power lines 50 hydraulically link hydraulic cylinder 30 to a hydraulic power system, not shown, of conventional configuration and well-known in the art.

The other end of the cylinder is attached to a fixed point of the frame or track. In the preferred embodiment, fixed cylinder mount 34 is provided on the upper back side frame 11 above track 14 formed thereon.

FIGS. 1 and 2 best illustrate means 20 for securing fence post 36 to traveling slide 16. In the preferred embodiment, securing means 20 is provided by cam type clamp 38. Clamp 38 has a first clamp surface, here fixed clamp surface 40, attached to slide 16 and a second clamp surface, cam clamp surface 42, presented by cam 44 which is rotatably mounted upon slide 16 upon bushing 46 mounted on bolt 48. Cam 44 is rotated upon bushing by manipulation of handle 52. See FIG. 1. The geometry of cam 44 about its mounted axis is such that rotation of the cam presents a varying radius of the cam on line between bolt 48 and first clamp surface 40. Thus, rotation of cam 44 closes and opens the gap between cam clamp surface 42 and first clamp surface 40, thereby gripping and releasing fence post 36, respectively. The cam clamp surface engages the fence post at a point below the axis of the cam establishing a self-locking engagement for driving the fence post and engages above the axis for a self-locking engagement to pull the fence post up.

The gap between the first clamp surface and the cam clamp surface provides an easily accessibly opening into which the fence post is conveniently inserted to rest adjacent traveling slide 16. Thus, exact placement is not necessary on the approach and engagement and disengagement do not require threading elements over the fence post, threading the fence post through elements or other timely and awkard operations.

Another attribute of securing means 20 is found in the manner of loading the fence post which minimizes bending forces thereon and provides extended support to the fence post against the traveling slide and, in the preferred embodiment, against first clamp surface 40.

In the illustrated embodiment, fence post 36 is a "T-post" and its seating of the fence post is facilitated by placing a vertical spacer 54 within clamp 38. Of course, the use of the present invention with other fence post configurations such as "U-posts" would be facilitated by spacers of different configurations.

The removal of wooden posts and other posts of non-standard configuration is facilitated by placing chain receiving notch 41 in the upper surface of fixed clamp surface 40. The end of a chain secured to a fence post is engaged in notch 41 and traveling slide 16 is raised carrying fixed clamp surface 40, the chain and the fence post upward.

To operate fence post driving and pulling apparatus 10, a fence post 36 of a standard configuration is seated against the front or face of traveling slide 16 and against the first clamp surface which, in the preferred embodiment, is fixed with respect to the traveling slide. Spacer 54 aids in orienting fence post 36 to a position such that a secure engagement is obtained when cam surface 42 is brought to engage fence post 36. Thus engaged, fence post 36 is fixed with respect to slide 16 between first clamp surface 40, the face of slide 16 and cam surface 42. Another method of adjusting clamp 38 for varying fence post configurations is to provide optional screw holes 56 for bolt 48.

Means are then actuated for driving the traveling slide. In the preferred embodiment, slide driving means 18 is provided by a hydraulic power supply or system presented on vehicle 26 upon which fence post driving and pulling device 10 is mounted. This hydraulic power supply operates hydraulic cylinder 30 which is mounted between traveling cylinder mount 28 attached to the back side of traveling slide 16 and fixed cylinder mount 34. Thus moving, traveling slide 16 forcefully carries fence post 36 downward to set or drive the fence post securely into the ground or, forcefully raises the fence post to pull the fence post from placement. See FIGS. 3 and 4.

Though the invention has been described and illustrated with a certain degree of particularity, it is understood that the present disclosure has been made by way of example only and that numerous changes in the details of construction and combination in arrangement of parts may be resorted without departing from the spirit and the scope of the invention as hereinafter claimed.

I claim:

1. A device connectable to a vehicle for driving a fence post comprising:
- a frame;
- a track formed on said frame by an I-beam having a web and flanges, said web having a vertical slot therein;
- means for mounting said frame to said vehicle;
- a substantially planar slide mounted adjacent said web of the track and slidably engaged on either side by the flanges of said track;
- a traveling cylinder mount projecting from said traveling slide and passing through said slot;
- a fixed cylinder mount connected to said frame;
- a hydraulic cylinder connected to said frame; and
- means for selectively securing said fence post to said traveling slide.

2. A device for driving a fence post in accordance with claim 1 wherein said means for selectively securing said fence post to said traveling slide comprises:
- a first clamp surface projecting from the said traveling slide;
- a cam rotatably connected to said traveling slide;
- a cam clamp surface on said cam;
- whereby said fence post is receivable to seat against said traveling slide between said first surface and said cam clamp surface.

3. A device for driving a fence post in accordance with claim 1 wherein said means for driving the traveling slide in vertical displacement is a hydraulic cylinder connected to said frame and to said traveling slide.

4. A device for driving a fence post in accordance with claim 1 wherein said means for mounting said frame on said vehicle comprises:

a pivot plate having an arcuate slot therethrough;

means for attaching the pivot plate to the vehicle;

a pivot bolt rotatably connecting the pivot plate to the frame;

a set bolt projecting from the frame through the arcuate slot and disposed to engage the sides of the arcuate slot upon tightening, thereby selectively securing the position of the pivot plate in relation to the frame;

whereby the means for mounting the frame to the vehicle is adjustable to compenstate for unlevel ground.

5. A device connectable to a vehicle for driving a fence post comprising:

a frame;

a track formed on said frame said track having a vertical slot therein;

means for mounting said frame to said vehicle;

a traveling slide disposed for substantial vertical displacement within said track;

a hydraulic cylinder connected to said track and disposed to drive said traveling slide;

means passing through said slot for connecting the hydraulic cylinder to said traveling slide; and a traveling slide clamp comprising:

a first clamp surface projecting from said traveling slide; and a cam rotatably connected to said traveling slide and having a cam clamp surface;

whereby said fence post is selectively securable to said traveling slide, seating against said traveling slide, said first clamp surface and said cam clamp surface.

6. A power operated fence post driving and pulling apparatus connectable to a hydraulic power source presented by a vehicle, said fence post driving and pulling apparatus comprising:

a frame;

means for mounting said frame to said vehicle;

a track formed on said frame;

a traveling slide comprising;

outwardly extending flanges on lateral edges of said frame; said outwardly extending flanges turning toward each other at their ends;

a substantially planar web of said frame between said flanges;

the said traveling slide being substantially planar; a vertical slot defined by said web;

a fixed cylinder mount formed on said track;

a traveling cylinder mount formed on said traveling slide and projecting through said slot; and said hydraulic cylinder being connected to said track at said fixed cylinder mount and connected to said traveling slide at said traveling cylinder mount;

means for slidably mounting said traveling slide within said track in a manner allowing substantially vertical displacement;

a hydraulic cylinder drivable by the hydraulic power source presented by said vehicle and connected between said track and said traveling slide, there disposed for vertically driving said traveling slide; and means for selectively securing said fence post to said traveling slide.

7. A fence post driving and pulling apparatus in accordance with claim 6 wherein said means for selectively securing said fence post to said traveling slide comprises:

a first clamp surface projecting from said traveling slide; and a cam rotatably connected to said traveling slide having a cam clamp surface;

whereby said fence post is selectively securable to said traveling slide, seating against said traveling slide, said first clamp surface and said cam clamp surface.

8. A fence post driving and pulling apparatus in accordance with claim 6 wherein said means for mounting said frame on said vehicle comprised:

a pivot plate having an arcuate slot therethrough;

means for attaching the pivot plate to the vehicle;

a pivot bolt rotatably connecting the pivot plate to the frame;

a set bolt projecting from the frame through the arcuate slot and disposed to engage the sides of the arcuate slot upon tightening thereby selectively securing the position of the pivot plate in relation to the frame;

whereby the means for mounting the frame to the vehicle is adjustable to compensate for unlevel ground.

9. A fence post driving and pulling apparatus connectable to a hydraulic power source presented by a vehicle, said fence post driving and pulling apparatus comprising:

a frame;

a track formed on said frame;

means for mounting said frame on said vehicle;

a traveling slide;

outwardly extending flanges on the lateral edges of said track; said outwardly extending flanges turning toward each other at their projecting ends;

a substanitally planar web of said track between said flanges;

a vertical slot defined by said web;

a fixed cylinder mount formed on said track;

a traveling cylinder mount formed on said traveling slide and projecting through said slot;

a hydraulic cylinder drivable by the hydraulic power source presented by said vehicle and connected between said track at said fixed cylinder mount and said traveling slide at said traveling cylinder mount;

a first clamp surface projecting from said traveling slide;

a cam rotatably connected to said traveling slide having a clamp surface;

whereby said fence post selectively securable to said traveling slide, seated against said traveling slide, said first clamp surface and said cam clamp surface.

* * * * *